United States Patent [19]

Hedrenius

[11] Patent Number: 4,492,001

[45] Date of Patent: Jan. 8, 1985

[54] METHOD TO CLEAN UP OIL SPILLS OR SIMILAR SUBSTANCES AND A DEVICE TO PRACTICE THIS METHOD

[75] Inventor: Stig Erik T. Hedrenius, Stockholm, Sweden

[73] Assignee: Sancon Aktiebolag, Stockholm Frihamn, Sweden

[21] Appl. No.: 427,579

[22] Filed: Sep. 29, 1982

[51] Int. Cl.[3] ..... A47L 7/00

[52] U.S. Cl. ..... 15/320; 15/409; 134/7; 134/21; 210/924

[58] Field of Search ..... 210/680, 691, 693, 694, 210/198.1, 242.4, 924, 925; 134/7, 21; 15/320, 409

[56] References Cited

U.S. PATENT DOCUMENTS

| | | | |
|---|---|---|---|
| 3,494,862 | 2/1970 | Horowitz | 210/924 |
| 3,800,950 | 4/1974 | Hess et al. | 210/924 |
| 3,964,925 | 6/1976 | Burgoon | 134/21 |
| 4,194,978 | 3/1980 | Crema | 210/924 |

*Primary Examiner*—Ivars Cintins

[57] ABSTRACT

A method and a device to clean up oil spills or similar substances. Sorbent material for oil or similar products is blown out by means of an air current on to the oil via a spreading duct through a spreading opening. The sorbent material is brought to sorb the oil and oil and sorbent material is sucked up by means of a suction opening via a suction duct to a receptacle.

1 Claim, 7 Drawing Figures

Figure 1:
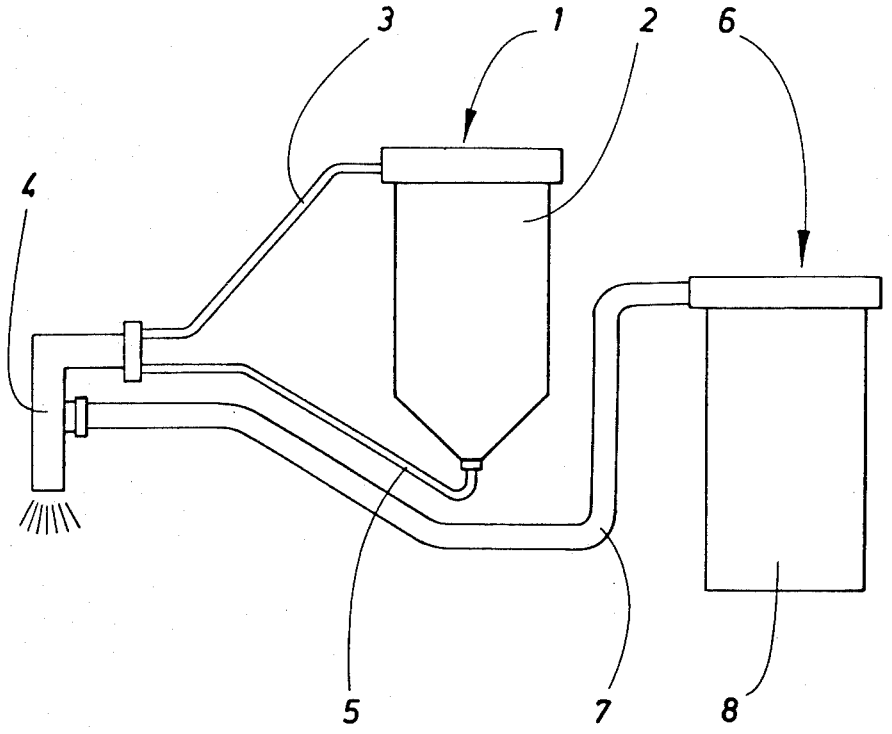

METHOD TO CLEAN UP OIL SPILLS OR SIMILAR SUBSTANCES AND A DEVICE TO PRACTICE THIS METHOD

The present invention relates to a method to clean up oil spills or simular substances.

The present invention also relates to a device for performing the method to clean up oil spills or similar.

Combat and clean up of oil on shores are, at the present time characterized by manual work involving simple tools and a lot of people during a long time. Where possible the contaminated part of the shore is taken away. Reeds are cut off. Grass, seaweeds, sand, flotsam and jetsam are raked up. This yields great amounts of waste mixed with oil. Boulders and rocky shores are brushed clean or cleaned with high-pressure jets of water. Clean up work on shorelines demands a great deal of time and manpower and is to a great extent dirtying. Simple tools are used like bag nets, spades, forks, rakes, etc.

Clean up on shores means great problems of transport. The collected waste is put in sacks or barrels and hampered to a central meeting point where the waste is put in large containers so that trucks can pick it up and take it to land fills, refuse dumps or incineration sites. Here separation of oil and waste is often tried.

The most common used clean up method in Sweden is cleaning with hot water hoses. This means that oil on rocky shores is washed off with high-pressure hot water hoses. The oil pours with the hot water into the water, spreading of the oil is prevented with a boom and the oil is recovered with any kind of sorbent material.

This known method is rather intensive, demands many preparing measures on the spill site, a lot of equipment and is rather slow.

Some people also think it is bad for the environment mainly by three reasons:

1. Severe damage to flora and fauna where the water jet hits the ground.
2. The shore line (littoral zone), which is very sensitive, is contaminated by the washed off oil.
3. All oil pouring into the water is not sorbed by the sorbent.

The purpose with this invention is to eliminate the trouble with the present technology at recovery of spill during combat and cleanup.

Another purpose is that the invention shall result in equipment which is easy available such as sludge pump trucks.

Combat and cleanup of oil on shores can be divided into the following sequences of operation:

1. Spreading
2. Mixing with oil
3. Recovery
4. Storage of recovered oil
5. Disposal The object of the invention is to make these sequences of operations easier and remove oil or similar substances from the ground, such as shores. The purpose of the invention is to do this in an easy, effective and laboursaving way.

The object of the present invention is achieved by the method which is characterized by that sorbent material for oil or similar products is blown out by means of an air current on to the oil via at least one spreading duct through a spreading opening, that the sorbent material is brought to sorb the oil and that oil and sorbent material is sucked up by means of a suction opening via a suction duct to a receptacle.

The object of the present invention is also achieved by the device which is characterized by that for the cleaning up there is utilized a device arranged to by means of an air current via at least a spreading hose and through a spreading opening spread out a sorbent material for oil and similar products for sorbtion of oil or similar and a device in order to suck up the mixture of oil and sorbent material as formed through a suction opening via a suction hose to a receptacle.

Figure 2:
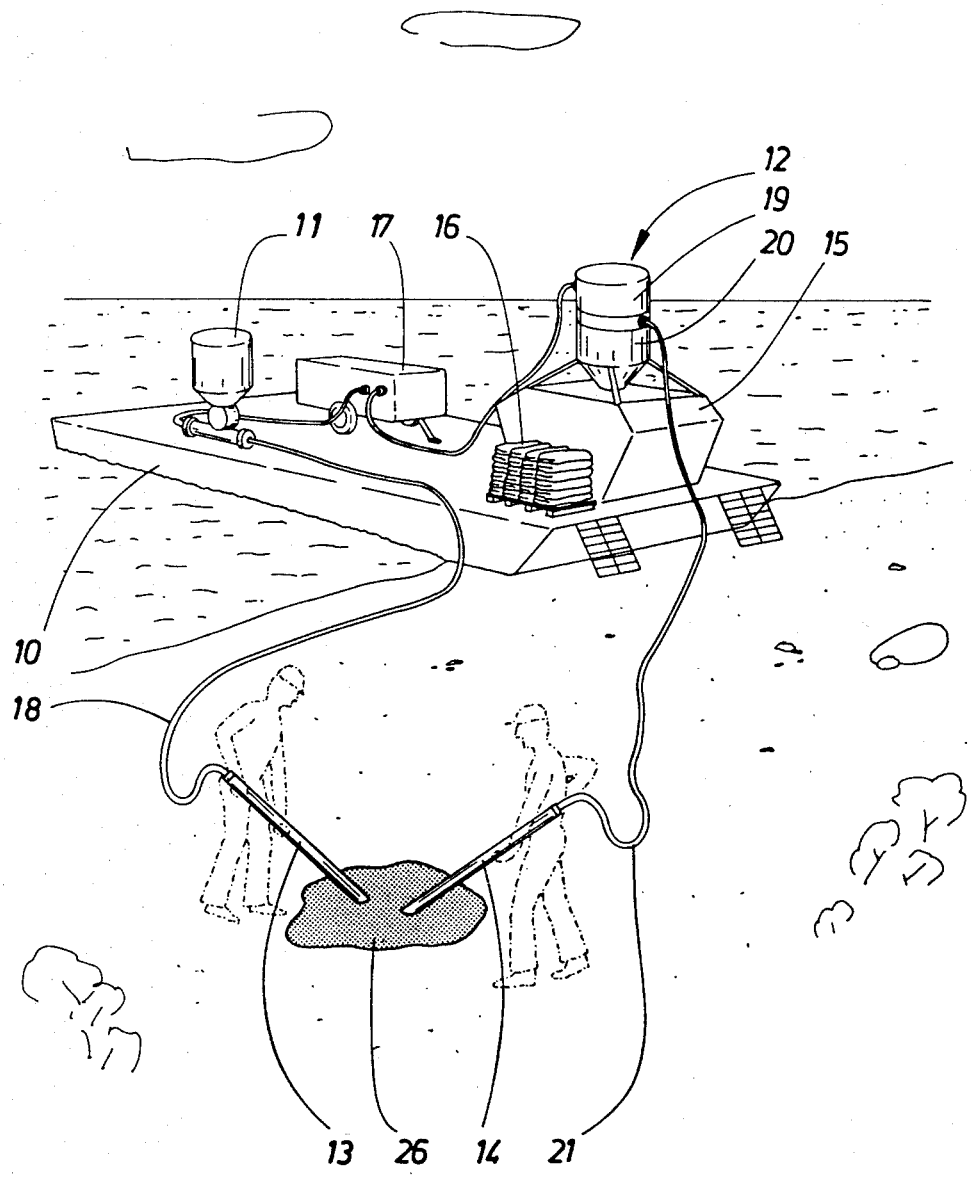
Figure 3:
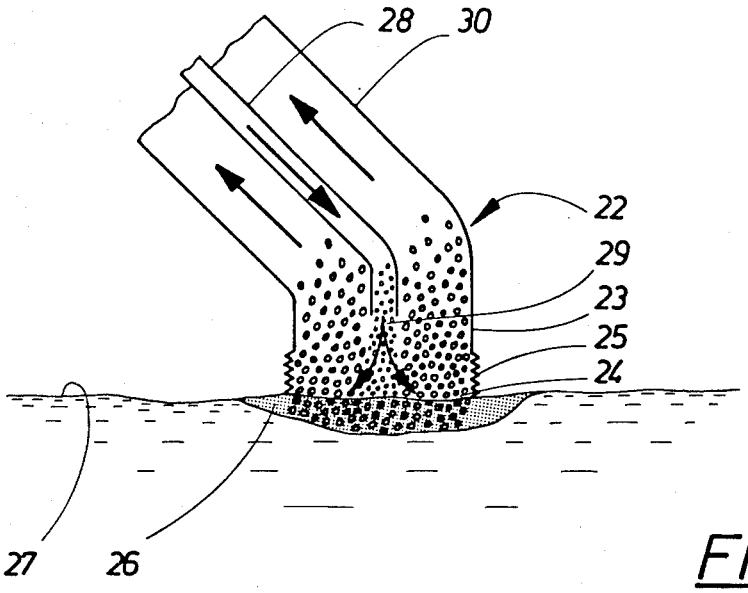
Figure 4:
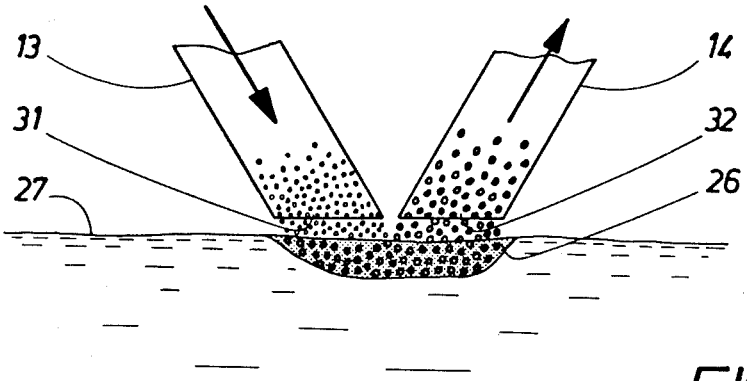
Figure 5:
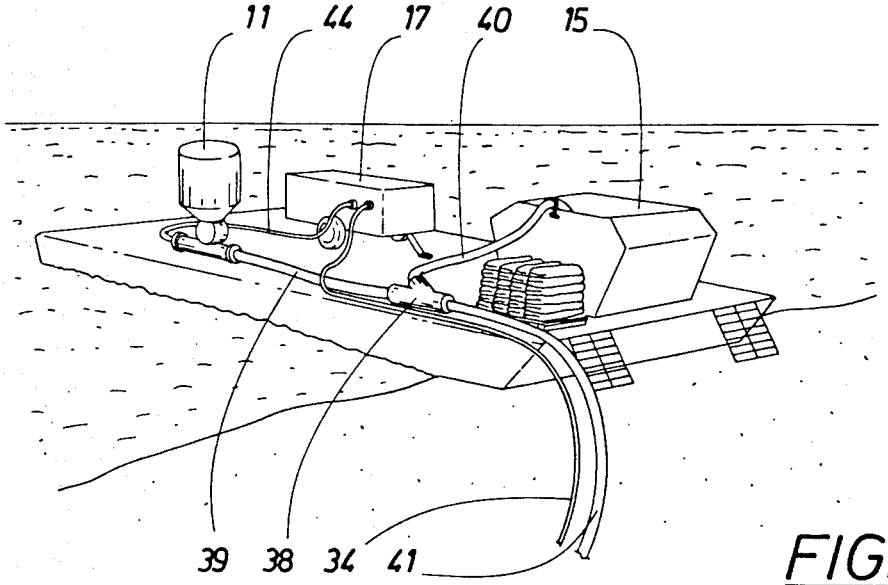
Figure 6:
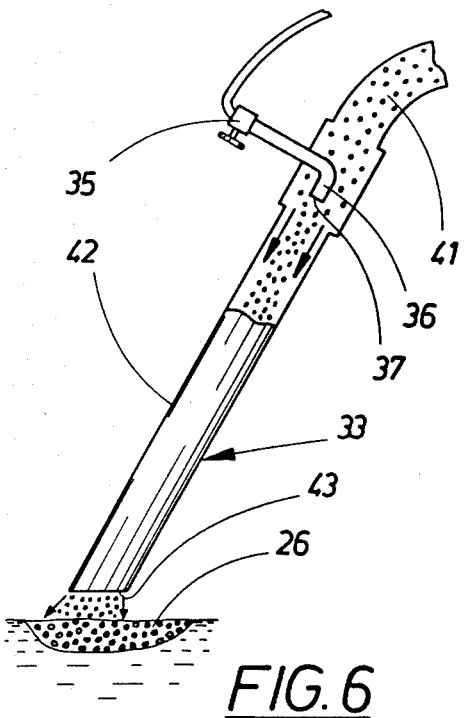
Figure 7:
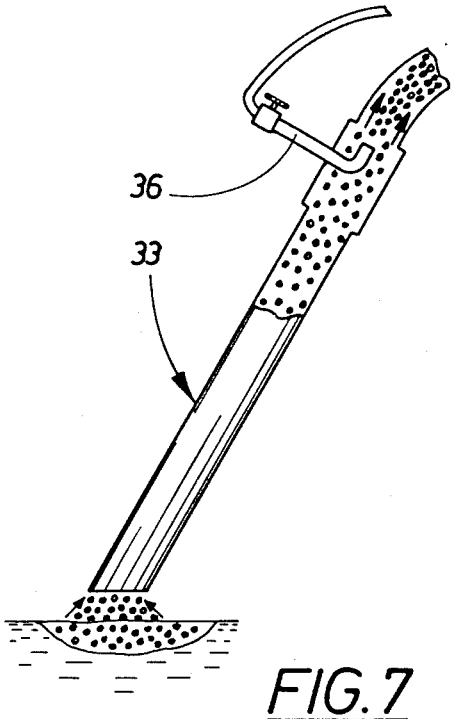

The invention is described in the following text by different embodiments with reference to the accompanying drawings, in which FIG. 1 shows a device for recovery of oil in compliance with the invention according to a first embodiment, FIG. 2 shows a concrete example of a device according to the invention, FIG. 3 shows schematically a partially broken section of a slightly modified nozzle included in the device, FIG. 4 shows a simplified partially broken section of two nozzles according to the invention, FIG. 5 shows another concrete example of a device according to the invention, FIGS. 6 and 7 show partly broken views of a nozzle in a further example.

The oil recovery equipment shown in FIG. 1 is designed as a device reminding of a blasting device. The device consists of a blast part 1 with a unit 2. From the unit high pressure air is transported in an air pipe to a nozzle 4. From this unit 2 to the nozzle also leads an air pipe for transportation of the treatment material or blasting grit for mechanical treatment of oil on surfaces, where the oil is. To this transportation air is also used from the unit 2 out into the pipe 5. The unit 2 represents an air compressor, a feed tank for sorbent material and a feeding out device for feeding this from the tank out in the pipe 5. The feeder can for example be a feed screw, a rotary vane feeder or similar. According to the invention the treatment material consists of sorbent material which is given motion energy by the compressed air. The equipment also consists of a suction unit 6 for recovery and storage of the so formed mixture of oil and sorbent. From the nozzle 4 leads a pipe 7 to the tank 8. The unit 6 represents an air ejector and a storage tank. This means that the air compressor in the unit 2 can be used also to create the necessary vaccum in the air ejector in the suction unit. The mixture of oil and sorbent is sucked through the nozzle and pipe and is emptied in the tank 8. This tank can be just a tank or built as a silo with a valve in the bottom so that the tank can be emptied into a sack or container. The sack is easily exchangeable and the tank is easy to empty of its content.

The invention is intended for outside use all around the year at more or less distant spill sites. On shores there are most of all demands of high flexibility and long hoses.

The treatment material for this invention is a sorbent material for oils, chemicals or similar substances. A choice can be made from any of the common sorbents which exists as granulate, such as crushed light concicle, pumice stone, expanded pearlite, grind pine bark, peat moss or sawdust.

The oil recovery equipment in FIG. 2 consists of the main components, working platform 10, spreading device 11, recovery (suction) device 12, nozzles 13, 14, storage for recovered oil 15, sorbent material 16 and power pack 17.

The equipment is to be transported on land and at sea. All equipment can be transported to and from the spill site by truck or by ship/boat/barge. The floating working platform can also carry all equipment. The main components can be transported to the quay side by truck or by barrow for loading on board. The equipment is mainly stationary on board but it can be carried or loaded ashore and so the equipment can operate without the ship/boat/barge.

The working platform 10 is a separate area on the spill site, e.g. a barge, but can also be a truck, ship or boat.

The spreading device 11 consists of a blow-fan or blast device which spreads sorbent material through nozzle 13 with such a speed and pressure (=motion energy) that the sorbent penetrates, absorbs and mixes with the oil. The oil is hereby removed from the ground. Thinner oil layers, millimeters and centimeters thick can be blasted away from the ground. From the filling-up part, where sorbent material is filled up, e.g. through a funnel or can, it is transported by compressed air through a hose 18 to the nozzle 13. To this nozzle 13, a separate hose with compressed air can be connected (corresponding to the pipe 3 in FIG. 1). This hose can, if needed, improve the "blast effect" by giving more pressure and speed to the sorbent material. The air pressure at the nozzle can thus be controlled. The controllable air pressure can be used under low pressure for example to cover an area with sorbents. (If it is not possible for example by lack of time in a restricted area for birds, the contaminated site can be covered with sorbents before a possible later cleanup.)

The spreading is operated by two persons. One stands at the filling-up part filling up sorbents. The other person handles the nozzle and spreads the sorbent.

The suction device 12 is meant to such the mixture of oil and sorbent. The mixture can also contain water, grass, sand, etc. The suction device consists of an air ejector producing the necessary vaccum and a storage tank 20, where air is separated and the oily waste is collected. The tank is designed as a silo with a valve in the bottom through which the silo can be emptied. The valve opens when the supply air is closed. To the tank is connected a suction hose 21 and is in its outer end connected to a suction nozzle 14.

The suction device 12 is operated by one person standing at the suction hose 14. Emptying the silo can be done without the operator leaving his place.

The storage tank is equipped with a rig and/or support legs to fit with the plastic sacks. The tank can be placed either on a container or directly on the shore.

The nozzles 13 and 14 belonging to the spreading and suction equipment are specially designed. Two main types can be used. The first one is shown in FIGS. 1 and 3. This type is a combined nozzle 4. The two functions spreading and suction are combined in one single nozzle handled by one person. This nozzle reminds of a blast-nozzle fitted with return suck. The two combined nozzles 4 and 23 shown in FIGS. 1 and 3 are functioning in the same way.

In FIG. 3 the nozzle is somewhat modified with an angled part down in the lower part. Fitted to the suction opening 24 of the nozzle are bellows or a screen 25. With this part the nozzle can be close to the oil spill 26 on the ground 27. The nozzle 22 according to FIG. 3 shows two mainly coaxial pipes. The inner pipe 28 spreads the granulated sorbent of suitable size by compressed air through a spreading opening. The other pipe 30 shall such the mixture of oil and sorbent. The inner pipe 28 is to be connected to the suction hoses 3 and 5 shown in FIG. 1. The outer pipe is to be connected to the suction hose 7. Like in the example according to FIG. 3 all pipes to and from the nozzle 4 and 22 are hoses, i.e. bendable and easy to handle.

The other type of nozzle unit 13 and 14 is shown in FIG. 2 with the above described performance. FIG. 4 shows a simplified partial view of the nozzle unit 13, 14. Here is a separate blow-out nozzle 13 for spreading sorbent through the spreading opening 31 and another separate suction-nozzle 14 for suction of the mixture of oil and sorbent 7 through the suction opening 32. This second type is handled with the two nozzles 13, 14 mechanically separated and independent of each other, suitably by two persons, one for each nozzle. By controlling the air pressure and the motion energy of the sorbent this can on one hand result in high blast-effect so the oil spill sorbed by the sorbent is removed in any desired direction and on the other hand result in coverng a spill site with sorbent using low air pressure. By this the spill site can be cleaned up part by part and the mixture is sucked by the other nozzle as the cleaning up work proceeds.

The storage of recovered oil is according to FIG. 2 a container and according to FIG. 1 a plastic sack. The sack is tightened at the lower part of the storage tank. The plastic sacks are then transported to a boat, truck or container. After the oily waste once is collected in containers it can be transported away to land fills for disposal or can be used as a fuel for example for heating.

In the present invention the treatment material is sorbent material for oils, chemicals or similar substances. Such a sorbent is functioning in two ways. It is porous and can absorb oil (absorption). It has also a big area, at which oil can stick (adsoprtion).

The amount of sorbent that is needed varies, but at least two parts are needed of sorbent material to sorb one part oil.

For this invention the most important property of the sorbent is that it makes the mixture not sticky and thus the mixture can be transported by compressed air through long hoses without them being plugged.

The power supply needed in this system can vary depending on different applications. The suction equipment must be supplied by an air compressor. All other devices can be supplied by air, electricity or hydraulic pressure.

The invention makes it possible to recover oil under summer as well as winter conditions.

In FIG. 5, a further concrete example of a device for cleaning up oil spills according to the invention is shown. This device coincides with respect to necessary equipment to a large extent with the device according to FIG. 2. As a difference from the device according to FIG. 2 the device according to FIG. 5 is provided to be utilized together with a combination nozzle 33, wiht is shown by means of an example in FIGS. 6 and 7. This device is namely provided to operate with an alternating action between spreading function and suction function and utilizes for the suction function no separate suction aggregate but instead ejector action at the nozzle by means of pressure air which is fed by means of a separate air hose 34 via a control valve 35 into the nozzle 33. An ejector 36 is pivotally journalled in the nozzle 33 so, that it can be adjusted for a direction forwards with its opening 37 in position for blowing action (FIG. 6) alternatively in a position rearwards with its opening in a position for suction function (FIG. 7). Instead of the pivotability the ejector can be provided with one outwards and one inwards directed opening, which alternatively are held open. Said device is further provided with a multiple joint 38, which is connected to a duct 39 from the spreading aggregate 11 for the sorbent material and a discharge hose 40, which ends in the container 15. For the forward feed of the sorbent material the air compressor 17 is still connected to the spreading aggregate 11 via an pressure air duct 44. Via the multiple joint 38 the two hoses 39, 40 are connected to a common transportation hose 41 for the spreading of the sorption material and for its suction together with the oil. This transportation hose 41 is connected to a nozzle tube 42, the opening 43 of which is held by means of an operator above the oil spill 26. The multiple joint 38 is suitable provided with a mechanism, not shown, for the control of the material in the desired direction. This mechanism can be arragned in the shape of valves, which alternatingly close the communication of the discharge hose 40 or the supply hose 39 with the transport hose 40 during the spreading period and the suction period respectively. This alternation can take place manually, by means of an electrical control or by means of pressure control caused by the pressure changes upon the adjustment of the ejector 36.

For the spreading of the sorbent material the suction hose 40 is consequently suitably closed at the multiple joint 38, whereas the spreading aggregate 11 and the compressor 17 are turned on, at the same time as the ejector 36 is turned forwards according to FIG. 6. This results in that sorbent material is transported through the duct 39 and the transport hose 40 and is given an increased kinetic energy by mean of pressure air through the pressure air duct 34 caused by ejector action. Sorption material is consequently blown out through the opening 43 and is brought to sorb the oil. When sufficient amount of sorbent material has been spread by means of the nozzle 33 the compressor 17 and the spreading aggregate 11 are for example turned off, whereafter the sorbent material is allowed to act for a while. Alternatively a direct alternation to the suction period can be made by means of a direct adjustment of the ejector 36 to the position shown in FIG. 7, whereafter by means of ejector action a suction power arises in the nozzle 33 and sorbent material together with sorbed oil is sucked up from the oil spill 26. Simultaneously with the alternation of the position of the ejector an adjustment of the mechanism takes place in the multiple joint 38 so, that its connection with the supply duct 39 is broken and the connection with the discharge hose 40 is opened so that sorbent material with oil is transported in the hose 41 and via the discharge hose 40 into the container 15. It should be remarked that the schematic view according to FIG. 1 also can be considered to represent the method described with reference to FIGS. 5, 6 and 7.

There are all kinds of shores that can be contaminated by oil spills such as sand-, grass-, gravel-, stone-, rock-, cobble-, reed branches and so on. There are different types of oils and there are different types of weather conditions. Because all external conditions are so different and vary so much this invention is characterized by high flexibility under different circumstances, different types of working platforms, different length of hoses, different nozzles, different storages of recovered oil and different power supplies are needed.

It is mentioned above that this invention can be used both in combat and cleanup operations of oil on shores. It can be used on all types of beaches except those where the oil is penetrating the ground. The oil must be present as a layer on the ground. The sorbent can absorb and adsorb the oil and can therefore be used on light oil and heavy (viscous) oils and chemicals. The sorbent must allow the oil to absorb without any chemical reactions occurring. The upper limit in viscosity is where the "blast effect" is not enough to penetrate the oil and bread the layer to pieces.

With the aid of the different nozzles (combined or separate) different oils can be recovered under different circumstances. For moderately sticky and viscous oils the best choice is the combined nozzle according to FIG. 3 if you do not wish the sorbent to spread.

To sorb light oils a single blow-out nozzle with low pressure is used to spread the sorbent and the light oil will not blow away. After a certain time (seconds or even minutes) the mixture is sucked by another single suction nozzle. Heavy oils are sorbed with a single high pressure blow-out nozzle and the sorbent is penetrating the oil and adhering to it. With this method the oil is removed from the ground. After this the mixture can be recovered with another single suction nozzle.

Besides this invention can be used to remove oil from all types of steel-, conrete and wooden structures contaminated by oil. For example piers, quays, breakwaters, bridges and piles. The combined nozzle is to prefer in such cases.

The invention is not restricted to the above described and the examples shown in the drawings. The nozzles can be performed in other ways. For example the combined nozzle can be made of two mechanically connected pipes with the inner pipe connected to the inner wall of the outer pipe or with the two pipes next to each other. The separate blow-out nozzle can besides the bevelled opening also have a special configuration, which favourably moves the mixture of oil and sorbent in wanted direction.

To prevent too much spreading of the sorbent when using separate nozzles, the blow-out nozzle can be fitted with a kind of screen, e.g. like half a sphere with the concave side towards the ground.

I claim:

1. A device for cleaning up pollutants resulting from oil spills and chemicals polluting an area on the ground by spreading granulate sorbent material over said area during a spreading period and sucking up the sorbent material carrying adsorbed pollutants from said area during a suction period, said device comprising supply means and first duct means for transporting the sorbent material respectively to and from a nozzle unit connected to said first duct means for blowing out and sucking up the sorbent material, second duct means for supply of compressed air, ejector means actuated by said compressed air and adjustable between a spreading position, taken during the spreading period, in which the ejector directs a first air current for transportation of the sorbent material in said first duct means up to the nozzle unit to blow the sorbent material out through the nozzle unit directly on said area causing the sorbent material to penetrate the polluted area by means of a blasting action and a sucking position, taking during the suction period, in which the ejector means directs a second air current for sucking up spreaded sorbent material carrying adsorbed pollutants and transportation of the polluted sorbent material via said first duct means to receptacle means for disposing of the polluted sorbent material, said ejector being mounted on the nozzle unit and pivotable between said spreading position and sucking position, said ejector including an outlet opening directed in said spreading position forwardly to a common spreading and sucking opening of the nozzle unit, and directed in said sucking position away from said common opening of the nozzle unit, and power means for the generation of compressed air for said second duct means, spreader means for feeding the sorbent material to said first duct means, said first duct means being common for the transportation of unpolluted sorbent material in a spreading period as well as polluted sorbent material in a suction period, and means adjustable between a first position during the spreading period in which the communication between the spreader means and first duct means is open, whereby communication between the receptacle means and the first duct means is discontinued, and a second position during the suction period in which communication between the spreader means and the first duct means is discontinued and the communication between the receptacle means and the first duct means is open.

* * * * *